US006131719A

United States Patent [19]

Gore

[11] Patent Number: 6,131,719

[45] Date of Patent: Oct. 17, 2000

[54] FRONT ENTRY ESCALATOR GUARD DEVICE

[75] Inventor: Nicholas Gore, Bristol, United Kingdom

[73] Assignee: Kleeneze Sealtech Limited, Bristol, United Kingdom

[21] Appl. No.: 09/213,746

[22] Filed: Dec. 17, 1998

[30] Foreign Application Priority Data

Dec. 19, 1997 [GB] United Kingdom ..... 9726883

[51] Int. Cl.[7] ..... B66B 21/00

[52] U.S. Cl. ..... 198/326; 198/323; 198/333

[58] Field of Search ..... 198/326, 323, 198/333

[56] References Cited

U.S. PATENT DOCUMENTS

| | | | |
|---|---|---|---|
| 3,986,595 | 10/1976 | Asano et al. | 198/333 |
| 4,004,676 | 1/1977 | Kraft | 198/326 |
| 4,413,719 | 11/1983 | White | 198/333 |
| 5,042,641 | 8/1991 | Soldat | 198/496 |
| 5,560,468 | 10/1996 | Inoue | 198/333 |
| 5,810,147 | 9/1998 | Vanmoor | 198/323 |

FOREIGN PATENT DOCUMENTS 2069438 8/1981 United Kingdom .

OTHER PUBLICATIONS

The Washington Post, "Metro Using Brushes on Escalator Gap Problem", Sep. 9, 1994, p. B3.

*Primary Examiner*—Jospeh E. Valenza
*Assistant Examiner*—Jeffrey A. Shapiro
*Attorney, Agent, or Firm*—MacMillan, Sobanski & Todd, LLC

[57] ABSTRACT

A guard device (1) comprising a deflector (8) for guarding the gap between an escalator step and an escalator side wall. The guard device (1) comprises an elongate body portion (2) having an elongate recess (4) adapted to receive a base of a deflector (8) with some play. A mouth (6) of the recess (4) is sufficiently wide to allow the base of the deflector (8) to be inserted through it into the recess (4). An elongate wedging element (10) is adapted to be slid into an end of the recess (4) between the end of the deflector (8) and a side wall of the body portion (2), thereby taking up the said play and retaining the deflector (8) in the body portion (2).

15 Claims, 7 Drawing Sheets

FRONT ENTRY ESCALATOR GUARD DEVICE

FIELD OF THE INVENTION

This invention relates to a guard device for guarding the gap between the sides of the steps of an escalator and the side wall of the escalator.

BACKGROUND OF THE INVENTION AND PRIOR ART

It is well known that the gap between the side wall of an escalator and an escalator step presents a risk of entrapment and is potentially dangerous to people using the escalator. Furthermore, if objects fall into the gap they may obstruct the mechanism or may present a fire hazard, It is therefore important that the gap is guarded (i.e at least partially covered) in use. To overcome these problems, it is known to use brush safety strips fixed to the sides of the escalator at a position just above the upper surface of the steps (the step nose line) to cover the gap and thereby to prevent objects from being trapped in or falling through the gap.

It is also known to provide a brush safety strip which is held to the escalator side wall by means of an elongate plastics or aluminium extrusion. During installation, the extrusion is screwed to the side wall of the escalator and then the brush strip is slid into a recess from one end of the extrusion. The brush strip is not particularly flexible, so problems can arise at the top and bottom transition radii of the escalator, in which areas it is necessary for the brush strip to follow the curve of the escalator steps- In order to allow the brush strip elements to be fitted easily, it has been necessary to split the plastics extrusion into straight portions and curved portions and to supply the brush strip in corresponding relatively short curved and straight lengths. This makes the fitting of the brush strips particularly difficult and time-consuming in the regions of the transition radii. An object of the invention is to facilitate the fitting of brush strip elements, and to improve the appearance of the installation as a whole.

According to the present invention there is provided a guard device comprising a deflector for guarding the gap between an escalator step and an escalator side wall, the guard device further comprising:

an elongate body portion having an elongate recess adapted to receive a base of the deflector with some play, a mouth of the recess being sufficiently wide to allow the base of the deflector to be inserted through it into the recess; and an elongate wedging element adapted to be slid into an end of the recess between the base of the deflector and a side wall of the body portion, thereby taking up the said play and retaining the deflector in the body portion.

Preferably the said side wall of the body portion is provided with a surface formation which interengages with a corresponding surface formation on the wedging element.

Preferably the wedging element is provided with a lip or ridge, which in the assembled condition of the guard device retains the base of the deflector in the recess.

Preferably the body portion comprises a base, the said side wall and a second side wall, the second side wall being provided with a lip or ridge in the region of the mouth of the recess, which, in the assembled condition of the guard device, retains the base of the deflector in the recess.

Preferably the base of the body portion is provided with fixing holes. The holes may be counter sunk to receive the heads of fixing elements such as screws or bolts.

Preferably the guard device further comprises an elongate mounting portion which is adapted to contact the escalator side wall, the body portion being provided with a formation which inter-engages with a corresponding formation provided on the mounting portion.

Preferably, one formation comprises a continuous recess and the other formation comprises a continuous rib. The rib is preferably barbed and the recess comprises a slot which narrows towards its mouth. Most preferably, the rib and the recess are substantially T-shaped in cross-section Preferably at least two formations are provided on the body portion and/or the mounting portion The formations preferably extend in parallel and at spaced apart locations along the body portion and/or the mounting portion. If there are a plurality of surface formations on the body portion and/or on the mounting. portion, preferably, one of the surface formations is higher or deeper than the others A plurality of body portions or mounting portions can be interconnected to space the deflector away from the side wall of the escalator. Although only a single deflector could be used, preferably the body portion is provided with a plurality of deflectors located one above the other when the guard element is installed on an escalator The deflectors preferably comprise lengths of brush strip which may be angled downwardly from the side wall or skirting panel towards the step nose line.

DETAILED DESCRIPTION OF A PREFERRED EMBODIMENT

Figure 1:
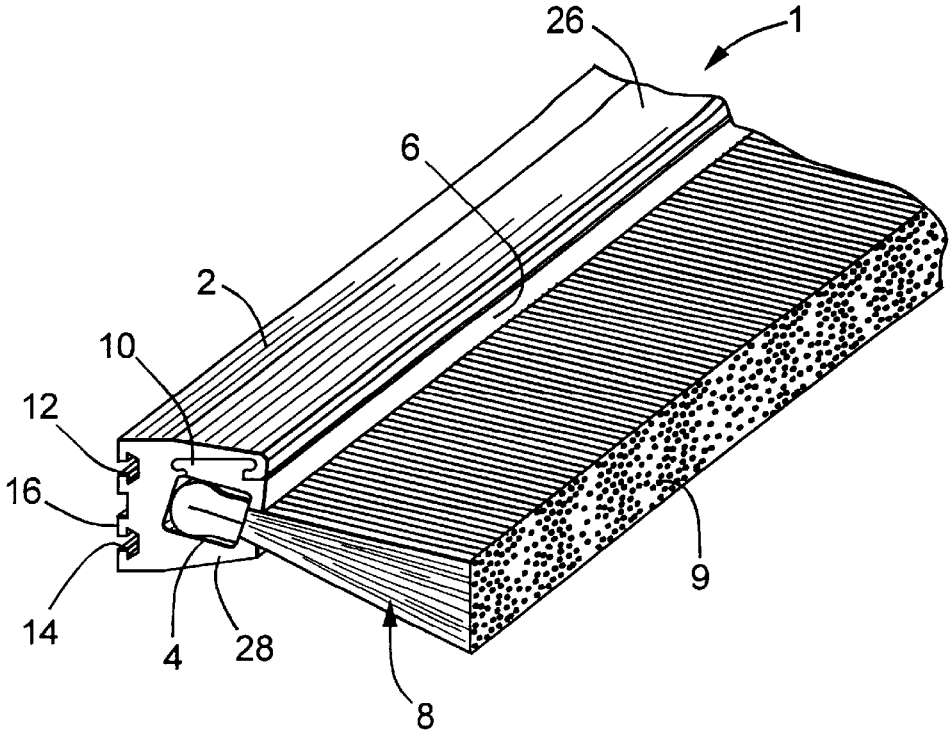
FIG. 1 shows a guard device.

FIG. 1 shows a first embodiment of guard device 1 comprising an elongate body portion 2 of aluminium or plastics material having an elongate recess 4 formed along its length and having a mouth 6 which opens along a front surface 7 of the body portion 2. A length of synthetic brush strip 8 is fitted into the recess 4 and is held in position by means of an elongate wedging element 10.

Surface formations, comprising T-shaped elongate recesses 12, 14, are integrally formed with the body portion 2 and project from its back surface 16. Each T-shaped recess 12, 14 is shaped to receive a corresponding surface formation comprising a substantially T-shaped rib la formed on an elongate mounting portion or spacer 20. The mounting portion 20 is made of aluminium or plastics material and may be formed in a variety of shapes and sizes for particular applications described later.

In accordance with various standard authorities, recommendations, the guard device 1 must be installed such that the outer end of the brush strip a lies just above the step noseline (NL in FIG. 11) of an escalator. The guard device 1 is held in this position by fixing the back surface 16 of the body portion 2 against or substantially parallel to a side wall panel or skirting panel of the escalator.

Figure 3:
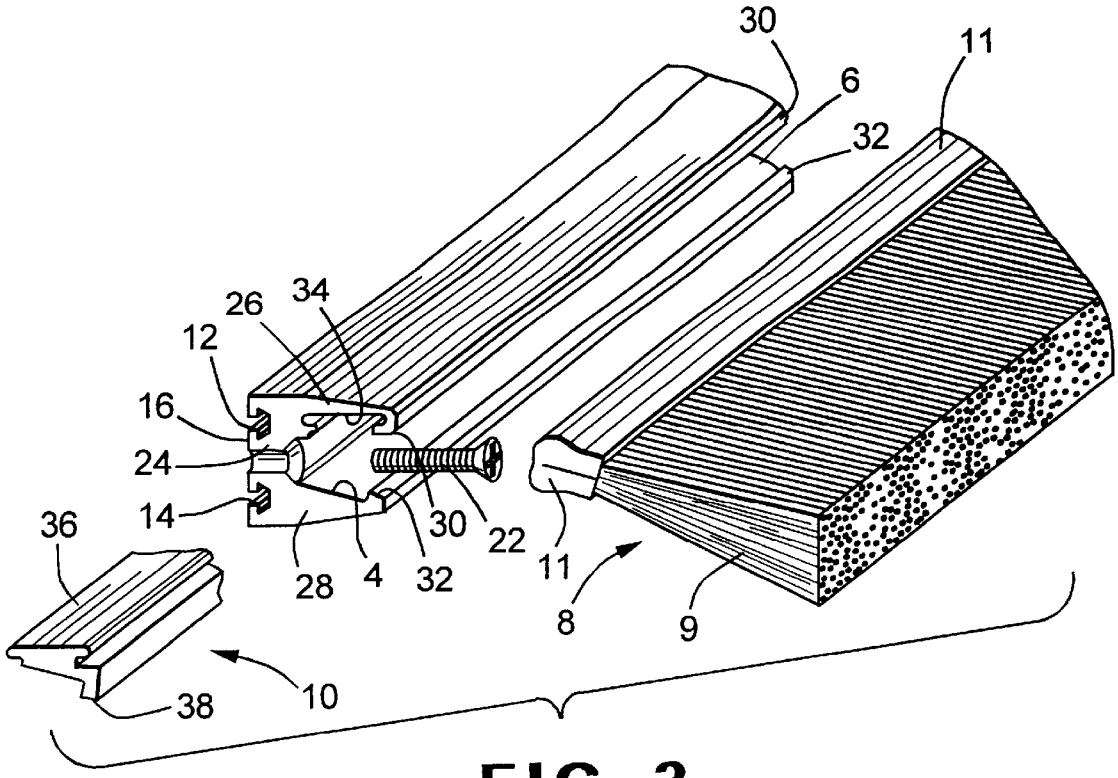
FIGS. 3 and 4 show steps in the assembly of a guard device.

As best shown in FIG. 3, in the simplest case, the body portion 2 is fixed directly to the escalator side wall or skirting by means of screws 22 driven through a base 24 of the body portion 2 into the side wall or skirting panel.

Figure 2:
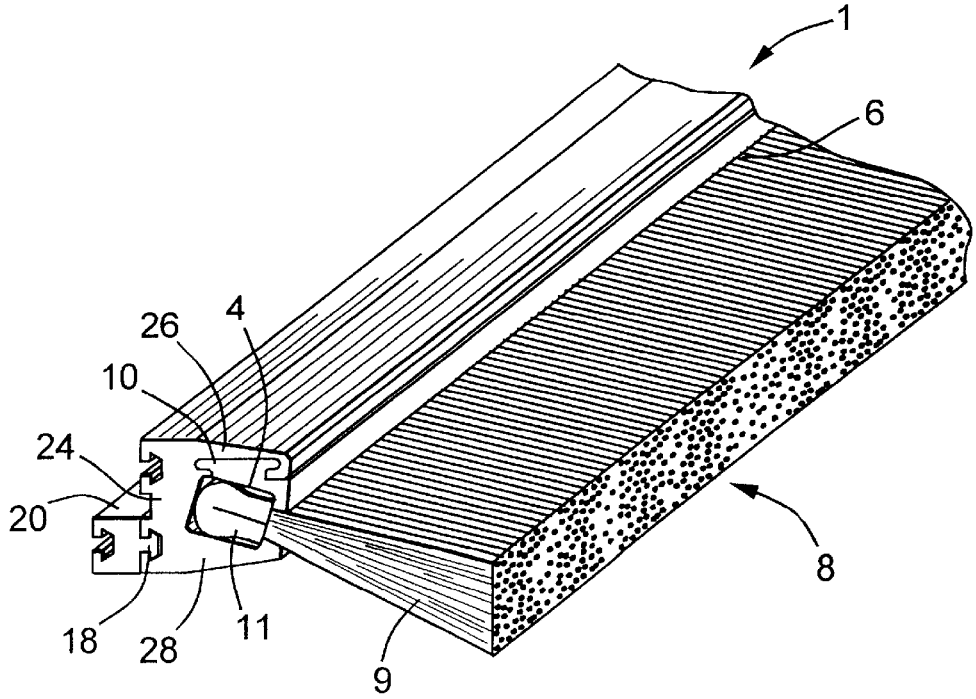
FIG. 2 shows a guard device having a mounting portion or spacer.

Alternatively, as in the arrangement illustrated in FIG. 2, it may be necessary to space one edge of the body portion 2 away from the side wall a greater distance than the other edge. This is achieved by attaching one or more mounting portions 20 to one or other edge of the body portion 2 or by fitting mounting portions 20 of different depths (not shown) to respective edges of the body portion 2. In such applications, the mounting portion 20 is fixed to the body portion 2 by pushing the T-shaped rib 18 on the mounting portion 20 into a respective T-shaped recess 12, 14 on the body portion 2.

To facilitate attachment of the mounting portion 20 to the body portion 2, the sides of the T-shaped rib 18 on the mounting portion 20 are tapered. A corresponding taper is provided on the side walls of the T-shaped recesses 12, 14 to ensure that the T-shaped rib 18 is a tight fit in the respective recess 12, 14.

The body portion 2 is substantially T-shaped in cross-section and comprises the base 24 and two side walls 26, 28, which together define the elongate recess 4. The free ends of the side walls 26, 28 are provided with inwardly directed ribs 30, 32 which together define the mouth 6 of the recess 4.

The inwardly directed surface of the upper side wall 26 is provided with a retaining recess 34 which is shaped to receive a continuous elongate rail 36 formed on the upper surface of the wedging element 10. The lower surface of the wedging element 10 is provided with a continuous rib 38.

The brush strip 8 is formed from a plurality of bristles 9 set in an elongate steel channel 11. When the brush strip 8 is installed in the body portion 2, the rib 32 on the lower side wall 28 and the rib 38 on the lower surface of the wedging element 10 impinge on the base of the bristles 9, and prevent the steel channel 11 being withdrawn from the recess 4.

Figure 4:
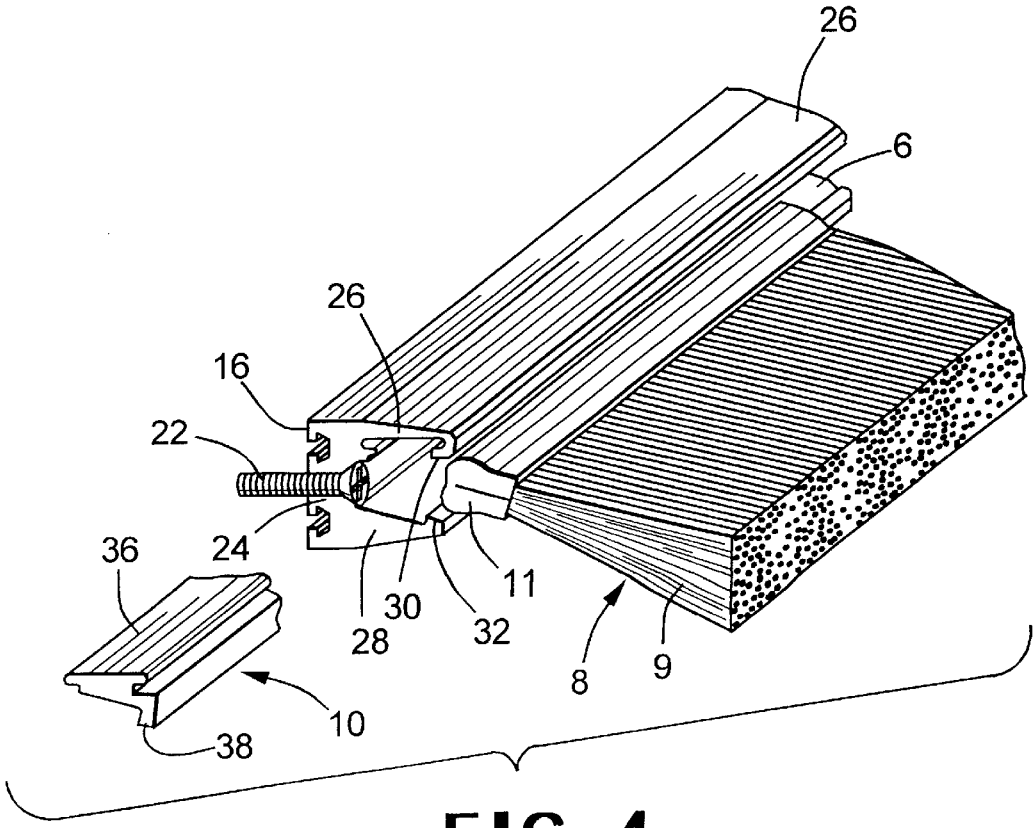

FIGS. 3 and 4 show the method by which the guard device 1 is assembled. Firstly the body portion 2 is screwed to the side wall or skirting panel of an escalator by means of screws 22 introduced through the mouth 6 of the recess 4. If necessary, one or more mounting portions 20 (see FIG. 2) may be attached to the body portion 2 before is fixed to the side wall or skirting panel.

Once the body portion 2 is firmly in place, the steel channel 11 of the brush strip 8 is inserted through the mouth 6 of the recess 4 until the free end of the steel channel abuts the base 24 of the body portion 2. The wedging element 10 is then slid from one end of the body portion 2 into the space between the steel channel 11 of the brush strip a and the upper side wall 26 of the body portion 2, such that the rail 36 on the wedging element 10 is engaged in and guided by the retaining recess 34. Once the wedging element 10 is firmly in place, any excess is cut away, leaving the brush strip a firmly trapped within the recess 4.

As will readily be appreciated, if the brush strip 8 needs to be replaced due to wear or damage it may be withdrawn through the mouth 6 of the recess 4, once the wedging element 10 has been withdrawn. Furthermore, brush strips a of different thicknesses or dimensions may be accommodated in a standard body portion 2, by use of alternative shapes and sizes of wedging element 10.

Figure 5:
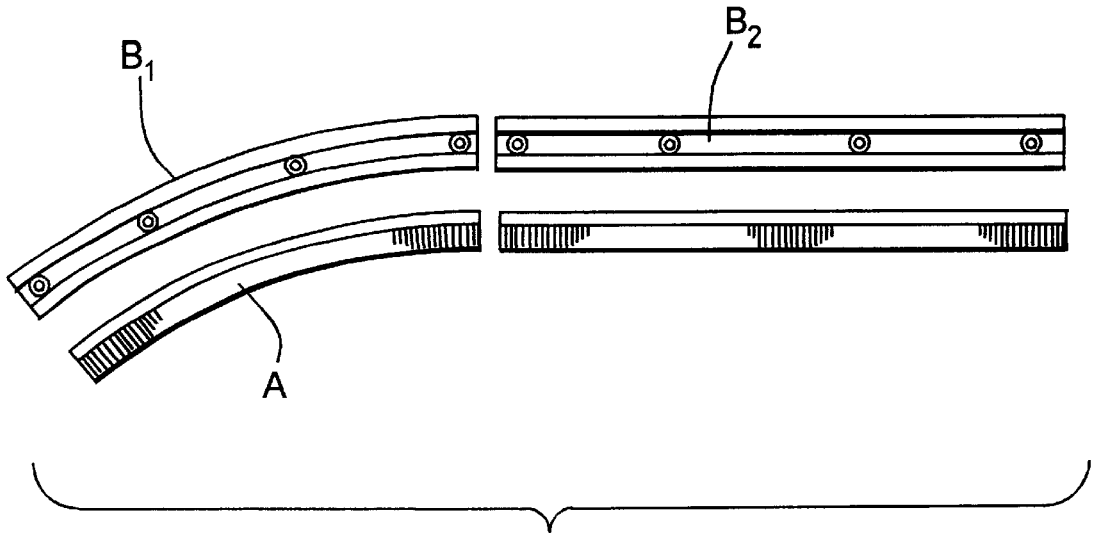
FIG. 5 is a view of a prior art guide device.
Figure 6:
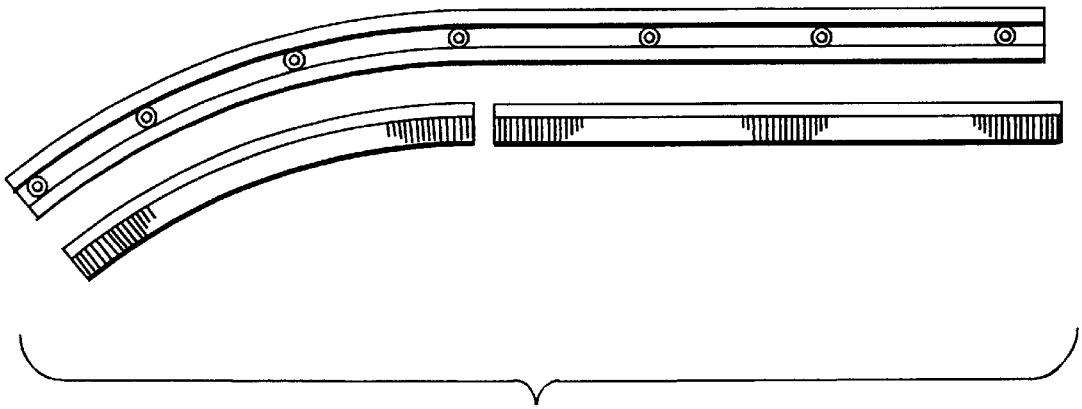
FIG. 6 shows a guard device for use at the transition zone at the top of an escalator.

Referring to FIGS. 5 & 6, a particular advantage of the present invention is clearly illustrated. FIG. 5 shows the prior art arrangement used for securing brush strip in the region of an upper transition radius of an escalator. In the prior art system, the brush strip A is inserted into a recess in the body portion B1 or B2 from one end and cannot be introduced through the mouth of the recess. Consequently, as the brush strip is relatively inflexible, a special curved brush strip is provided for the transition radius and a straight brush strip is provided for the straight portion of the escalator- In order to fit these brush strips, it is necessary to provide the body portion B in two parts B1, B2, because as one is fitting the body portion to the escalator, one works from the top down or from the bottom up and hence will only be able to insert the brush strip from one end of the body portion. Thus, if the body portion was formed in one piece it would be necessary at one end of the escalator to force a straight portion of brush strip around a curved body portion in order to properly locate the brush strip in the next straight length of body portion. This problem is entirely overcome by use of the present invention, since the brush strip can be introduced into the recess in the body portion directly through the mouth of the recess. As a result of this, an arrangement as illustrated in FIG. 6 may be used in which the body portion for the transition radius and the body portion for the straight length of escalator are formed in one piece. This one piece unit is quicker and easier to fit and hence reduces the cost of installing a guard device on an elevator.

FIGS. 7 to 12 show alternative arrangements for fixing the body portion 2 to an escalator side wall or skirting panel. These figures do not show a wedging element 10, but it is to be understood that the wedging element 10 may be used with these embodiments, merely requiring modification of the recesses 104, 106, such that the brush strips 108, 110 can be inserted through the mouth of the respective recesses.

Figure 7:
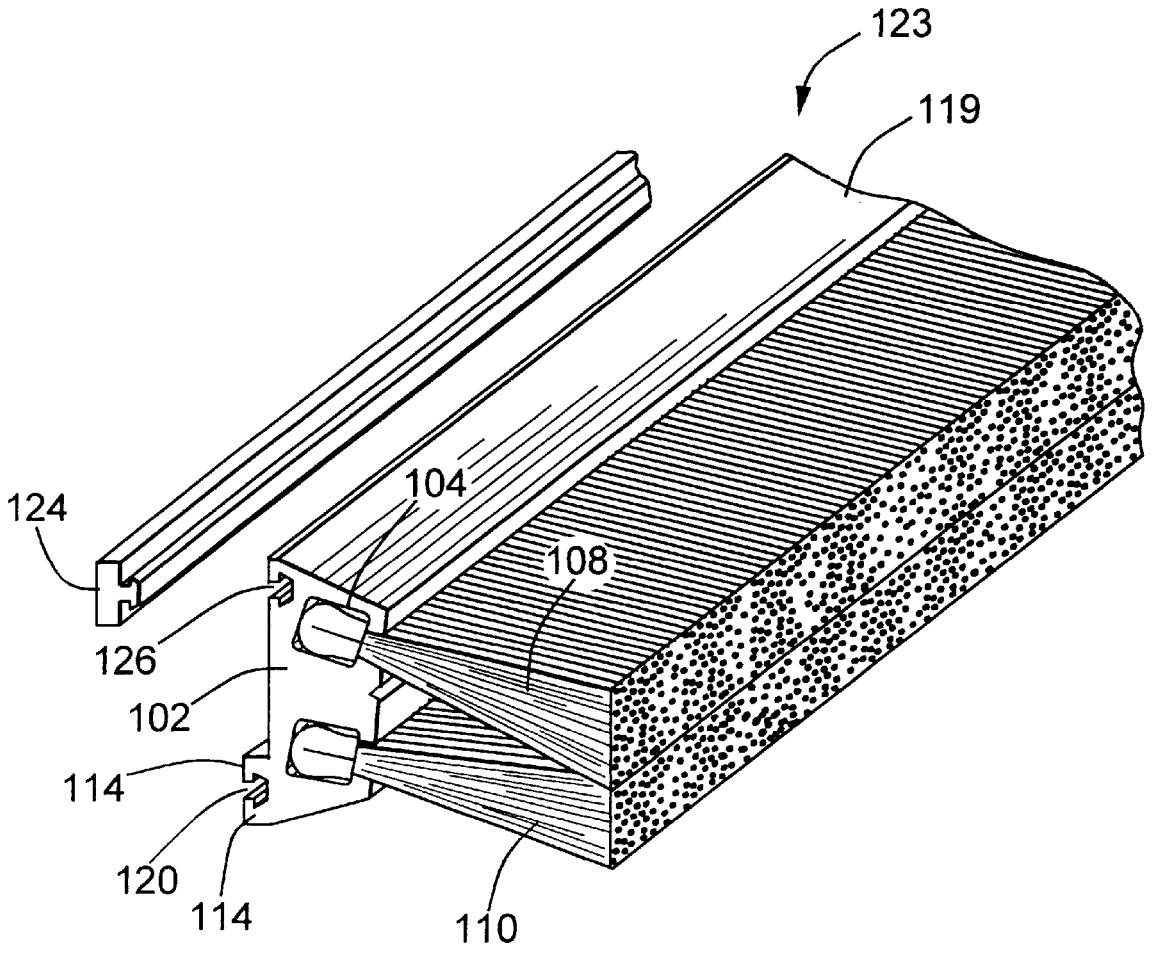
FIG. 7 shows a guard device having two deflectors.

FIG. 7 shows a second embodiment of guard device 123 in which a single elongate rib 114, having a continuous T-shaped recess is provided along the lower edge of a body portion 119. In addition, a second elongate T-shaped recess 126 is formed directly in the inner surface 116 at the upper edge of the body portion 119. The T-shaped recess 126 is identical in size, shape and orientation to the T-shaped recess 120 formed in the rib 114 and can receive mounting portions 124 in the same way.

Figure 8:
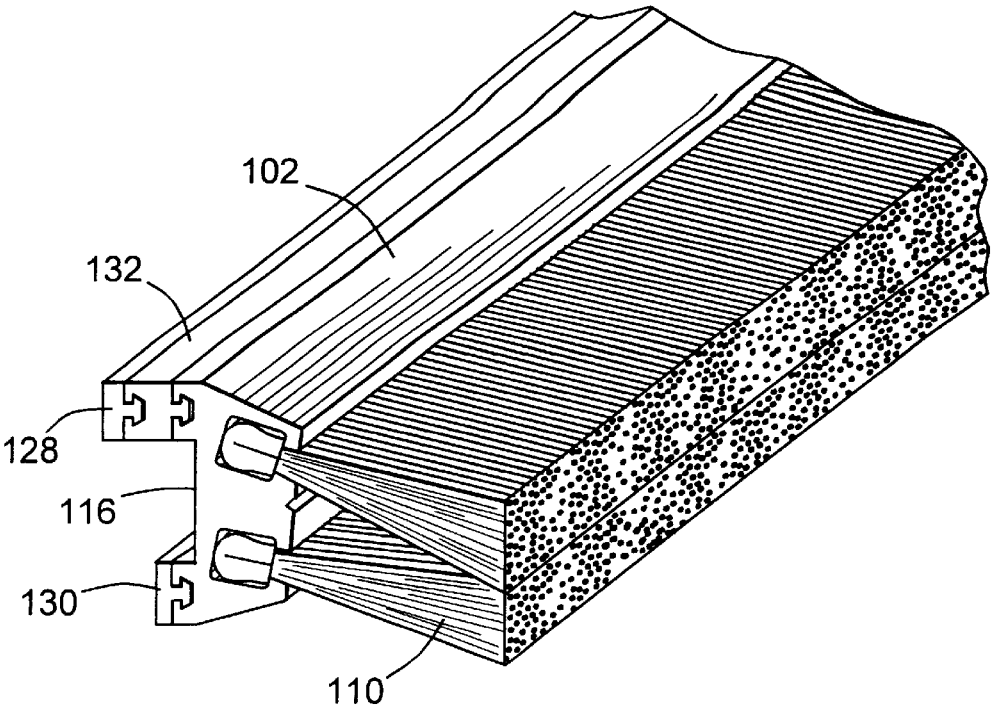
FIG. 8 shows a guard device having a plurality of mounting portions or spacers.
Figure 9:
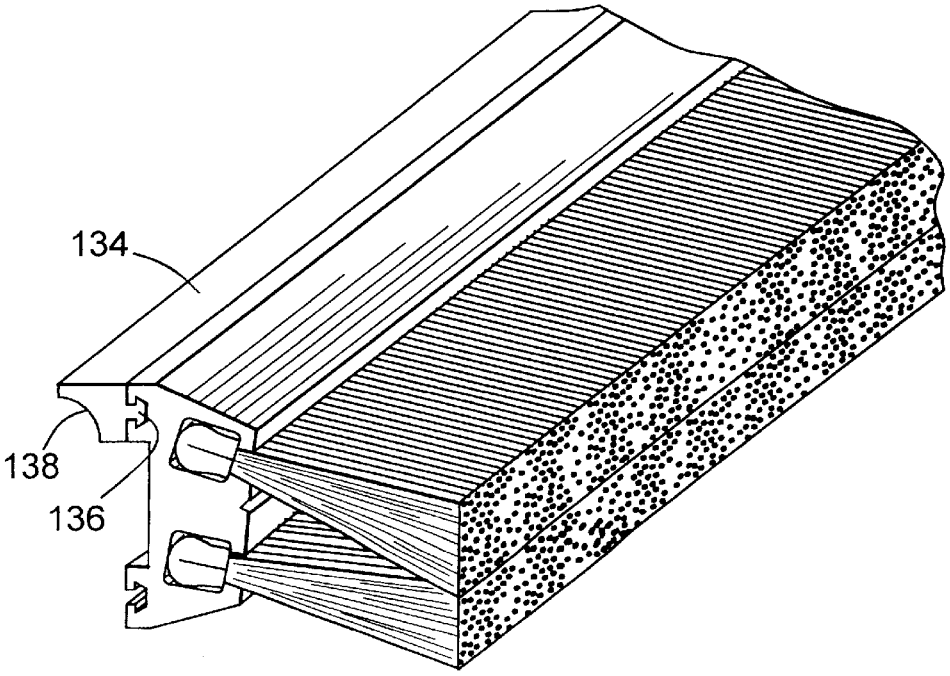
FIG. 9 shows a guard device having a shaped mounting portion or spacer.

Referring to FIG. 8, by selecting mounting portions 128, 130 of different thicknesses, it is possible to space the body portion 102 a desired distance away from the side wall. It is also possible to "step over" side wall features such as skirting panels. In other words, a thinner mounting portion 130 is fixed to the upper rib 112 of the body portion 102 and a thicker mounting portion 128 is fixed to the lower rib 114 of the body portion 102. The body portion 102 is then screwed to the escalator side wall such that the thinner mounting portion 130 contacts the skirting panel and the thicker mounting portion 128 contacts the side wall panel.

In applications in which a very large discontinuity must be overcome, it is also possible to use one or more spacers 132 which have on one side a male surf ace formation which plugs into a surface formation of the body portion 119 or into an additional spacer 132. On its other side, each spacer 132 has a female surface formation into which a mounting portion 128 or an additional spacer 132 may be plugged.

There are also circumstances in which the side wall or skirting of the escalator does not present a flat mounting surface. In such circumstances a mounting portion 134 having a male surface formation 136 on one side and a shaped surface 138 on the other side may be employed. Mounting portions 134 having a variety of profiles are preferably made available to the fitter, so that the most common discontinuities or surface profiles can be accommodated. For example, the upper edge of skirting is often curved and it would therefore be useful to have a mounting portion 135 having a profile on its inner surface 138 which conforms to the curve on the upper surface of the skirting.

Figure 10:
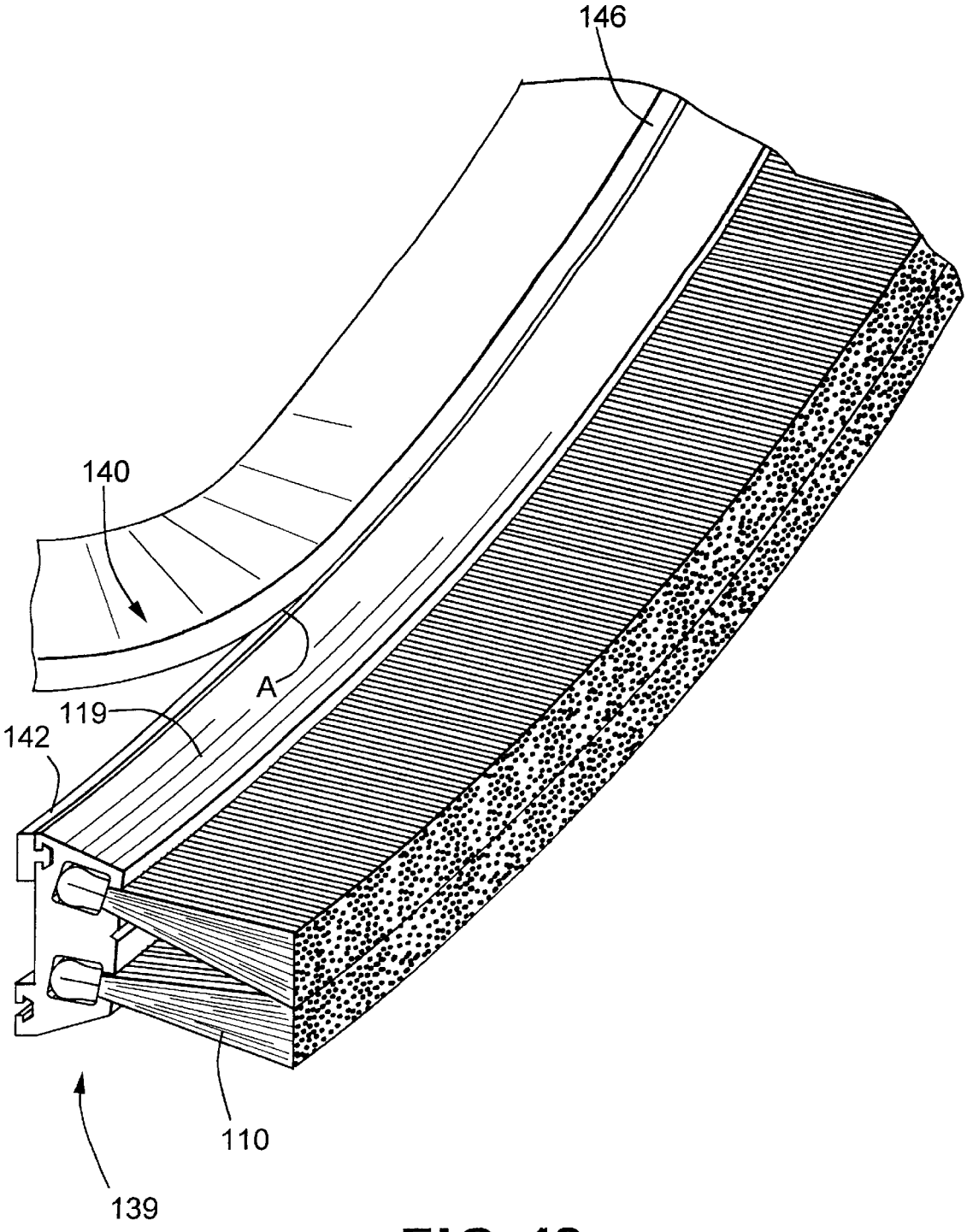
FIG. 10 shows a guard device installed at the bottom of the transition radius of an escalator.

FIG. 10 shows a guard element 123 installed on an escalator in the region of the bottom transition radius 140. In this application of the second embodiment of the invention, the thickness of the mounting portion 142 is selected so that it equals the depth of the side wall feature. Alternatively, a combination of mounting portions and spacers may be used to make up the gap. As will be appreciated, there is no need to use a mounting portion above the point A in FIG. 10 because, from that point on, the upper edge of the body portion 119 can be fixed directly to the sidewall decking 146. The mounting portion 142 or spacer is therefore cut off at the point A with a saw or sharp knife.

Figure 11:
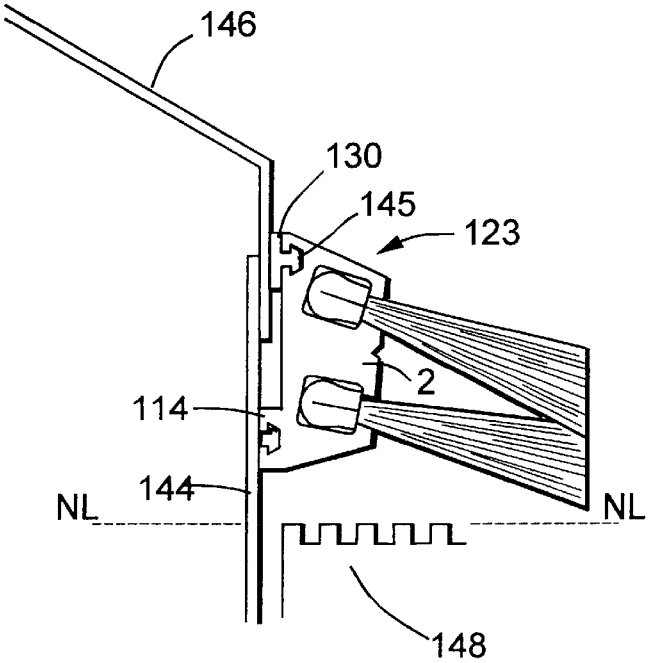
FIG. 11 shows a guard device installed on an escalator incline.

FIG. 11 shows a guard element 123 mounted on an inclined portion of escalator. In this application, the elongate rib 114 of the body portion 119 directly engages the skirting panel 144 of the escalator.

Conventional escalators may have side wall decking 146 which overlaps the skirting panel 144 If the thickness of the side wall decking 146 is less than the thickness of the elongate rib 114 on the body portion 119, the resulting gap can be made up using a thin mounting portion 130. The thin mounting portion 130 is held in place by engagement of a T-shaped rib 145 on the mounting portion 130 in the T-shaped recess 126 formed directly in the body portion 119.

Figure 12:
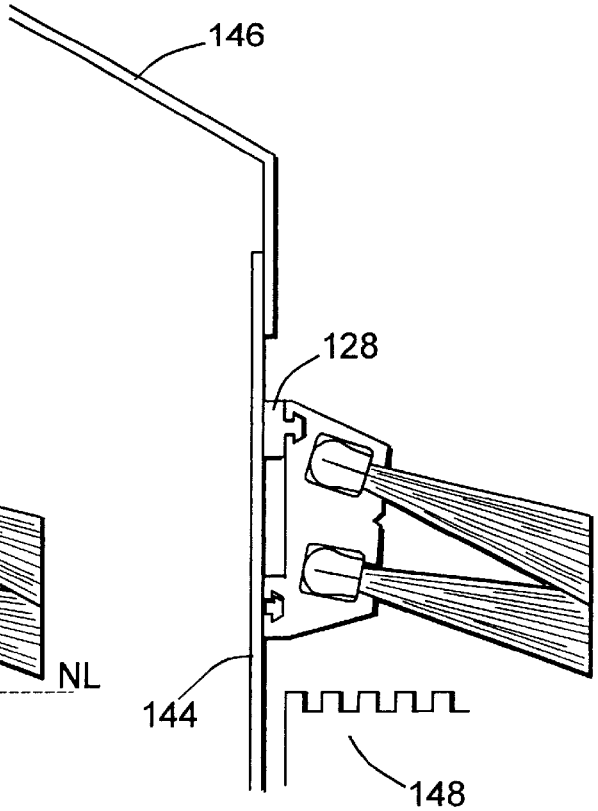
FIG. 12 shows a guard device installed on an escalator landing.

On an escalator having a landing, the arrangement illustrated in FIG. 11 is modified to the arrangement illustrated in FIG. 12 in the region of the landing. In other words, on a landing, the side wall decking 146 moves away from the step nose line NL, so the guard element must be mounted entirely on the skirting panel 144. At the transition to a landing from an incline, the thin mounting portion 130 is replaced by a thicker mounting portion 128. Other discontinuities and peculiar shapings of the escalator can be overcome in a straightforward manner by use of mounting portions and spacers of appropriate size and shape.

It is to be understood that the foregoing embodiments are intended to be illustrative of the invention and that other embodiments are also contemplated. For example, any type or number of deflectors may be used instead of the brush strips 108, 110. Furthermore any number, shape or disposition of surface formations on a body portion and a mounting portion are contemplated and any means of fixing the mounting portions and/or body portion to the side wall of an escalator are also contemplated. The invention may also be applied to the mounting of guard elements on or in the vicinity of other parts of an escalator.

What is claimed is:

1. A guard device comprising a deflector for guarding the gap between an escalator step and an escalator side wall, the guard device further comprising:

an elongate body portion having an elongate recess adapted to receive a base of the deflector with some play, a mouth of the recess being sufficiently wide to allow the base of the deflector to be inserted through it into the recess; and an elongate wedging element adapted to be slid into an end of the recess between the base of the deflector and a side wall of the body portion, thereby taking up the said play and retaining the deflector in the body portion.

2. A guard device as claimed in claim 1, in which the side wall of the body portion is provided with a surface formation which inter-engages with a corresponding surface formation on the wedging element.

3. A guard device as claimed in claim 1, in which the wedging element is provided with a lip or ridge, which in the assembled condition of the guard device retains the base of the deflector in the recess.

4. A guard device as claimed in claim 1, in which the body portion comprises a base, the said side wall and a second side wall, the second side wall being provided with a lip or ridge in the region of the mouth of the recess which, in the assembled condition of the guard device, retains the base of the deflector in the recess.

5. A guard device as claimed in claim 1, in which the base of the body portion is provided with fixing holes.

6. A guard device as claimed in claim 5, in which the holes are counter sunk to accommodate the heads of fixing elements.

7. A guard device as claimed in claim 1, further comprising an elongate mounting portion which is adapted to contact the escalator side wall, the body portion being provided with a formation which interengages with a corresponding formation provided on the mounting portion.

8. A guard device as claimed in claim 7, in which one formation comprises a continuous recess and the other formation comprises a continuous rib.

9. A guard device as claimed in claim 8, in which the rib is barbed and the recess comprises a slot which narrows towards its mouth.

10. A guard device as claimed in claim 8, in which the rib and the recess are substantially T-shaped is in cross-section.

11. A guard device as claimed in claim 1, in which at least two formations are provided on the body portion, the formations extending in parallel and at spaced apart locations along the body portion and being adapted to engage with cooperating formations on respective mounting portions.

12. A guard device as claimed in claim 11, in which one of the surface formations is higher or deeper than the other or others.

13. A guard device as claimed in claim 11, in which two or more mounting portions are interconnected to space the deflector away from the side wall of the escalator.

14. A guard device as claimed in claim 1, in which the deflector comprises a length of brush strip.

15. A guard device as claimed in claim 1, in which the body portion is provided with a plurality of deflectors which are located one above the other when the guard element is installed on an escalator.

* * * * *